US011735098B2

(12) United States Patent
Takasugi

(10) Patent No.: US 11,735,098 B2
(45) Date of Patent: Aug. 22, 2023

(54) LIGHT EMITTING DISPLAY DEVICE

(71) Applicant: LG DISPLAY CO., LTD., Seoul (KR)

(72) Inventor: Shinji Takasugi, Tokyo (JP)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/115,428

(22) Filed: Dec. 8, 2020

(65) Prior Publication Data

US 2021/0183304 A1 Jun. 17, 2021

(30) Foreign Application Priority Data

Dec. 13, 2019 (JP) ..... 2019-225309

(51) Int. Cl.
*G09G 3/32* (2016.01)

(52) U.S. Cl.
CPC ..... *G09G 3/32* (2013.01); *G09G 2310/0275* (2013.01); *G09G 2310/08* (2013.01)

(58) Field of Classification Search
CPC ..... G09G 3/32; G09G 2310/0275; G09G 2310/08
See application file for complete search history.

(56) References Cited

U.S. PATENT DOCUMENTS 9,349,317 B2 5/2016 Kim et al.
2009/0206764 A1* 8/2009 Schemmann ..... H02H 9/001 315/241 R
2010/0091041 A1* 4/2010 Ono ..... G09G 3/3233 345/76
2011/0285691 A1 11/2011 Takasugi et al.
2014/0098082 A1* 4/2014 Kwon ..... G09G 3/3233 345/212

(Continued)

FOREIGN PATENT DOCUMENTS

CN 103165076 B * 8/2015 ..... G09G 3/3208
JP 2011-242767 A 12/2011

(Continued)

OTHER PUBLICATIONS

Office Action issued in corresponding Korean Patent Application No. 10-2020-0084660, dated Jun. 23, 2021.

*Primary Examiner* — William Boddie
*Assistant Examiner* — Nathaniel P Brittingham
(74) *Attorney, Agent, or Firm* — Morgan, Lewis & Bockius LLP

(57) ABSTRACT

A light emitting display device where a pixel circuit detecting a threshold voltage of a driving transistor in each of a plurality of subpixels is arranged in a matrix, includes: a threshold voltage estimating part generating a threshold voltage estimation value by estimating the threshold voltage of the driving transistor through a data counting method; a reference voltage modifying part generating a reference voltage modification value by modifying a reference voltage used for detecting the threshold voltage based on the threshold voltage estimation value; an image data voltage modifying part generating an image data voltage modification value by adding a threshold voltage detection value to a data voltage corresponding to an image data; and an accumulated deterioration calculating part calculating an accumulated deterioration by accumulating a deterioration data of a function of the data voltage.

20 Claims, 12 Drawing Sheets

(56) References Cited

U.S. PATENT DOCUMENTS

| | | | | |
|---|---|---|---|---|
| 2014/0176409 | A1 | 6/2014 | Kim et al. | |
| 2016/0189623 | A1* | 6/2016 | Miwa | G09G 3/3258 345/212 |
| 2017/0278459 | A1* | 9/2017 | Jeon | G09G 3/3291 |
| 2019/0066587 | A1* | 2/2019 | Han | H01L 27/1218 |

FOREIGN PATENT DOCUMENTS

| | | | |
|---|---|---|---|
| KR | 10-2014-0091095 | A | 7/2014 |
| KR | 10-2014-0116702 | A | 10/2014 |

* cited by examiner

LIGHT EMITTING DISPLAY DEVICE

CROSS REFERENCE TO RELATED APPLICATIONS

The present application claims the priority benefit of Japanese Patent Application No. 2019-225309 filed in the Japan Patent Office on Dec. 13, 2019, which is hereby incorporated by reference in its entirety for all purposes as if fully set forth herein.

BACKGROUND

Technical Field

The present disclosure relates to a light emitting display device, a display device including a driving a transistor.

Discussion of the Related Art

Recently, a light emitting display device where an image of a high quality is stably displayed has been required.

In the related art light emitting display device, since a threshold voltage of a driving thin film transistor in a subpixel is shifted due to deterioration, a stable image display of a high quality is not obtained.

As a result, an inner compensating pixel circuit which detects the threshold voltage of the driving transistor and compensates a data voltage by adding the detected threshold voltage in the subpixel of the light emitting display device has been suggested.

For example, in a Japanese Patent Publication No. 2011-242767, a technology where a voltage is applied to a reference voltage line and a threshold voltage is detected is disclosed.

In a Korean Patent Publication No. 10-2014-0116702, an inner compensating pixel circuit is disclosed as another example.

However, in the inner compensating pixel circuit, when a threshold voltage shift of a driving transistor progresses, a current flowing the driving transistor is insufficient at an initial detecting state. As a result, it is impossible to detect the threshold voltage.

In a U.S. Pat. No. 9,349,317, a data counting method where a shift amount of a threshold voltage is presumed from accumulation of an image data and a compensation is performed based on the presumed value is disclosed.

However, an accuracy of the presumed value of the threshold voltage is inferior to an accuracy of the detected value of the threshold value.

SUMMARY

Accordingly, embodiments of the present disclosure are directed to a light emitting display device that substantially obviate one or more of the problems due to limitations and disadvantages of the related art.

An object of the present disclosure is to provide a light emitting display device where a threshold voltage is detected at an initial detecting state of a driving transistor and a compensation is performed based on a detected value of the threshold voltage.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, a light emitting display device, where a pixel circuit detecting a threshold voltage of a driving transistor in each of a plurality of subpixels is arranged in a matrix, comprises: a threshold voltage estimating part generating a threshold voltage estimation value by estimating the threshold voltage of the driving transistor through a data counting method; a reference voltage modifying part generating a reference voltage modification value by modifying a reference voltage used for detecting the threshold voltage based on the threshold voltage estimation value; an image data voltage modifying part generating an image data voltage modification value by adding a threshold voltage detection value to a data voltage corresponding to an image data; and an accumulated deterioration calculating part calculating an accumulated deterioration by accumulating a deterioration data of a function of the data voltage.

In another aspect, a light emitting display device comprises: a plurality of subpixels arranged in a matrix, each of the plurality of subpixels including a voltage compensating pixel circuit having a driving transistor and an emission element emitting a light due to a control of the voltage compensation pixel circuit; a timing controller outputting a control signal to a data driving circuit and a gate driving circuit connected to the plurality of subpixels based on a timing synchronization signal and a data current; and a memory part remembering one of a deterioration data of each of the plurality of subpixels and an average deterioration data of the plurality of subpixels, wherein the timing controller detects a threshold voltage of the driving transistor as a threshold voltage detection value by modifying a reference voltage using a threshold voltage estimation value of a shift amount of the threshold voltage through a data counting method and modifies an image data voltage using the threshold voltage detection value.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles. In the drawings.

DETAILED DESCRIPTION

Figure 1:
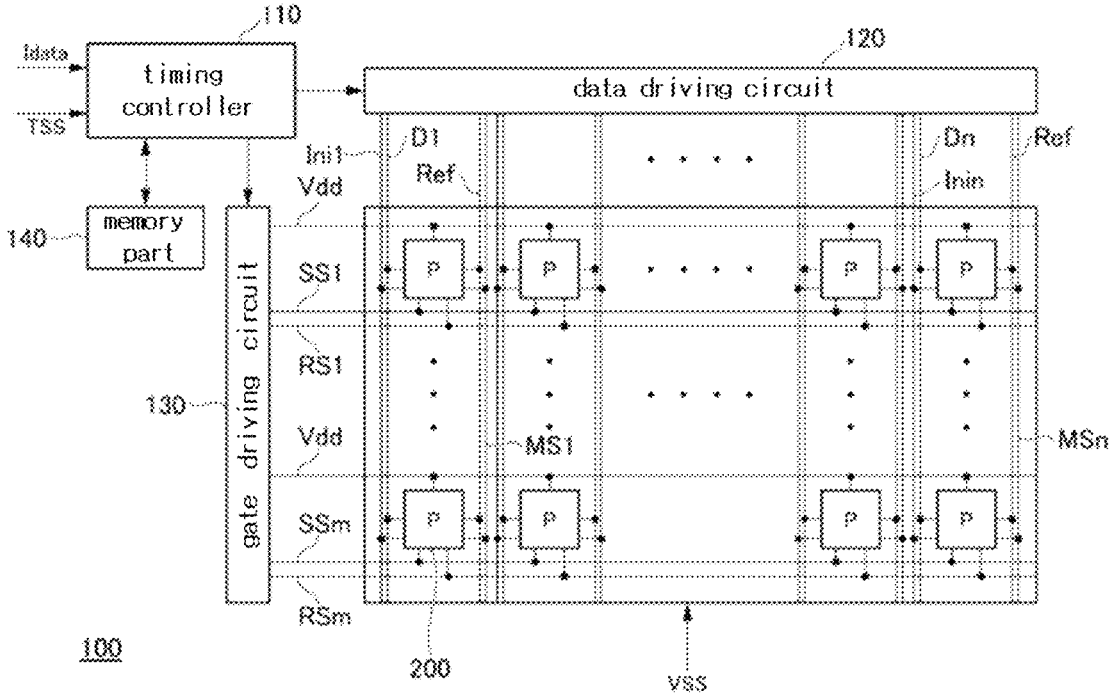
FIG. 1 is a view showing a light emitting display device according to a first embodiment of the present disclosure.

Reference will now be made in detail to embodiments of the present disclosure, examples of which may be illustrated in the accompanying drawings. In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations are selected only for convenience of writing the specification and may be thus different from those used in actual products.

Advantages and features of the present disclosure, and implementation methods thereof will be clarified through following example embodiments described with reference to the accompanying drawings. The present disclosure may, however, be embodied in different forms and should not be construed as limited to the example embodiments set forth herein. Rather, these example embodiments are provided so that this disclosure may be sufficiently thorough and complete to assist those skilled in the art to fully understand the scope of the present disclosure. Further, the present disclosure is only defined by scopes of claims.

Reference will now be made in detail to the present disclosure, examples of which are illustrated in the accompanying drawings.

FIG. 1 is a view showing a light emitting display device according to a first embodiment of the present disclosure.

In FIG. 1, a light emitting display device 100 includes a timing controller 110, a data driving circuit 120, a gate driving circuit 130, a memory part 140 and a plurality of subpixels 200 arranged in a matrix.

The timing controller 110 outputs control signals to the data driving circuit 120 and the gate driving circuit 130 based on a timing synchronization signal TSS and a data current Idata.

The timing synchronization signal TSS includes a vertical synchronization signal, a horizontal synchronization signal, a data enable signal and a clock signal, etc.

The data driving circuit 120 outputs signals to first to nth data signal lines D1 to Dn and first to nth merge signal lines MS1 to MSn, supplies an initial voltage Vini to first to nth initial voltage lines Ini1 to Inin, and supplies a reference voltage Vref to a reference voltage line Ref, based on the control signals from the timing controller 110. Here, n is a natural number.

The gate driving circuit 130 outputs signals to a high level voltage line Vdd, first to mth scan signal lines (gate signal lines) SS1 to SSm and first to mth reset signal lines RS1 to RSm based on the control signals from the timing controller 110. Here, m is a natural number.

The memory part 140 remembers an average deterioration data of at least one subpixel 200 or all subpixels 200 in a panel.

The plurality of subpixels 200 defined by the first to nth data signal lines D1 to Dn, the first to nth merge signal lines MS1 to MSn, the first to nth initial voltage lines Ini1 to Inin, the reference voltage line Ref, the high level voltage line Vdd, the first to mth scan signal lines SS1 to SSm and the first to mth reset signal lines RS1 to RSm are disposed in a matrix.

Each of the plurality of subpixels 200 includes an emission element 220 and a pixel circuit for emitting the emission element 220.

The emission element 220 emits a light according to a current from a power line of the high level voltage Vdd to a power line of a low level voltage Vss through a driving transistor in the pixel circuit.

Figure 2:
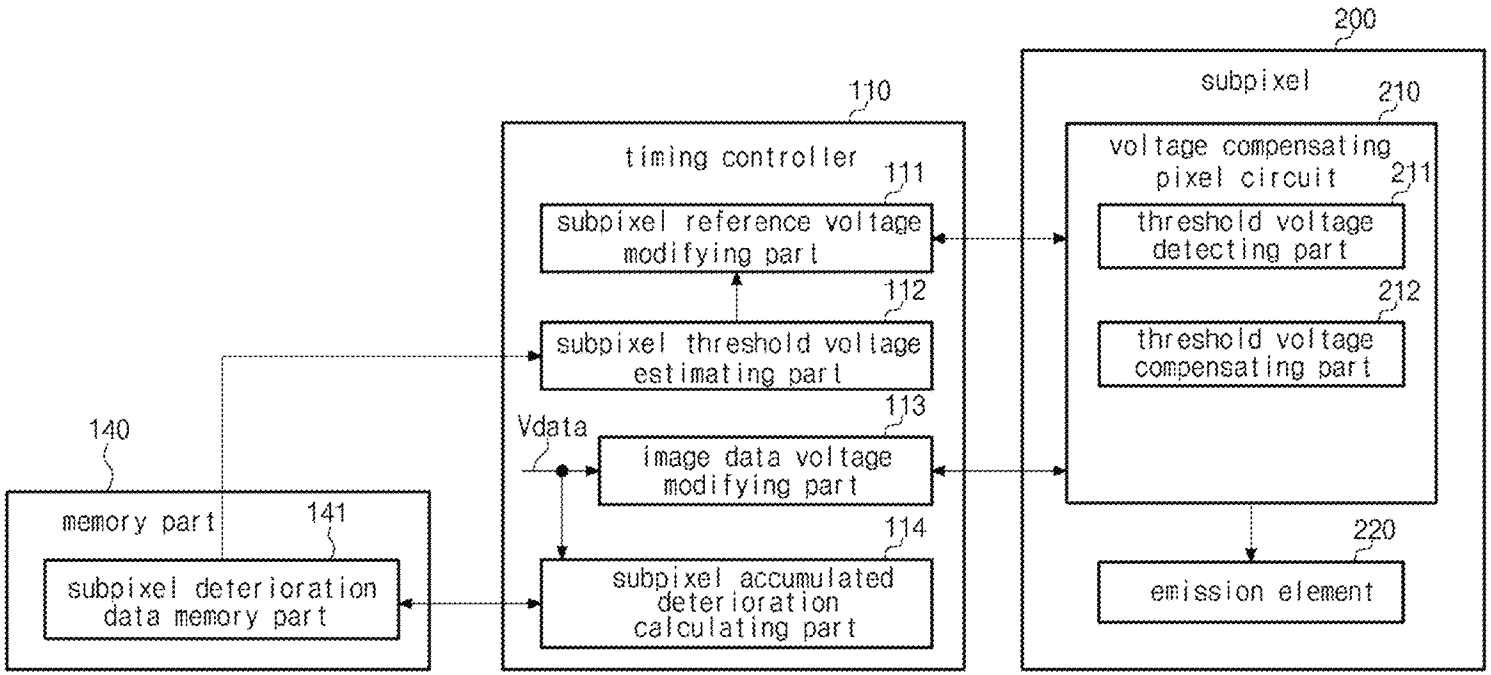
FIG. 2 is a view showing a timing controller, a memory part and a subpixel of a light emitting display device according to a first embodiment of the present disclosure.

FIG. 2 is a view showing a timing controller, a memory part and a subpixel of a light emitting display device according to a first embodiment of the present disclosure.

In FIG. 2, the timing controller 110 includes a subpixel reference voltage modifying part 111, a subpixel threshold voltage estimating part 112, an image data voltage modifying part 113 and a subpixel accumulated deterioration calculating part 114.

The subpixel reference voltage modifying part 111 modifies the reference voltage Vref by adding a threshold voltage detection value Vthd of the driving transistor to the reference voltage Vref in each subpixel 200.

The subpixel threshold voltage estimating part 112 generates a threshold voltage estimation value Vthe by estimating the threshold voltage of the driving transistor in each subpixel 200.

The subpixel threshold voltage estimating part 112 estimates a shift amount of the threshold voltage in a deterioration state based on a subpixel deterioration data from the memory part 140 and generates the threshold voltage estimation value Vthe based on the shift amount of the threshold voltage.

The image data voltage modifying part 113 modifies an image data voltage by adding the threshold voltage estimation value Vthd to a data voltage Vdata based on an image data.

The subpixel accumulated deterioration calculating part 114 calculates an accumulated deterioration of the subpixel by adding a function f(Vdata) of the data voltage Vdata to the subpixel deterioration data in each subpixel 200.

The memory part 140 includes a subpixel deterioration data memory part 141.

The subpixel deterioration data memory part 141 remembers the deterioration data in each subpixel 200.

The subpixel 200 includes a voltage compensating pixel circuit 210 having the driving transistor and the emission element 220.

The voltage compensating pixel circuit 210 includes a threshold voltage detecting part 211 and a threshold voltage compensating part 212.

The threshold voltage detecting part 211 generates the threshold voltage detection value Vthd by detecting the threshold voltage of the driving transistor in each subpixel 200.

The threshold voltage compensating part 212 compensates the data voltage Vdata by adding the threshold voltage detection value Vthd in each subpixel 200 to the data voltage Vdata.

The emission element 220 includes an anode connected to the driving transistor in each subpixel 200, a cathode connected to the low level voltage line Vss and an emitting layer between the anode and the cathode.

The emitting layer includes an electron injecting layer, an electron transporting layer, an emitting material layer, a hole transporting layer and a hole injecting layer sequentially laminated between the cathode and the anode.

When a forward bias is applied between the anode and the cathode, an electron from the cathode is supplied to the emitting material layer through the electron injecting layer and the electron transporting layer and a hole from the anode is supplied to the emitting material layer through the hole injecting layer and the hole transporting layer.

A fluorescent material or a phosphorescent material of the emitting material layer emits a light with a luminance proportional to a current density by a recombination of the electron and the hole.

When a reverse bias is applied, the emission element 220 functions as a capacitor storing charges.

Figure 3:
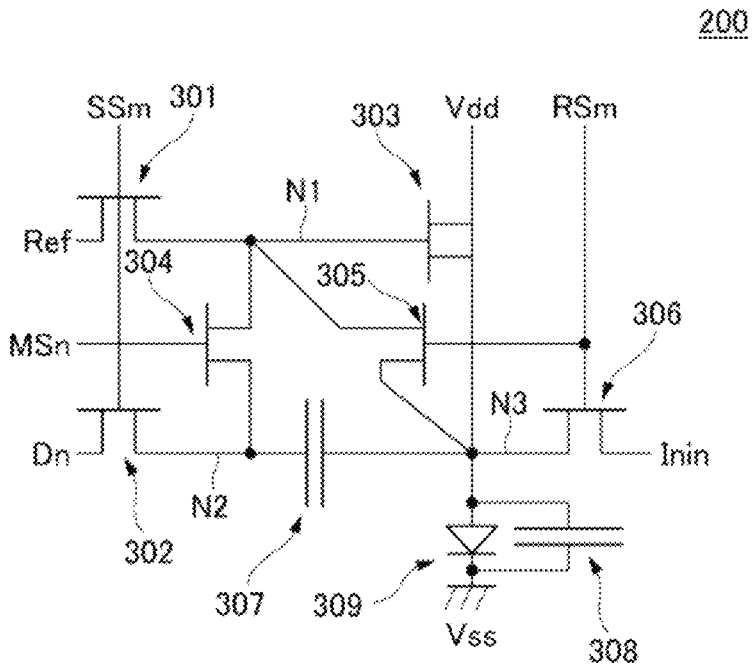
FIG. 3 is a pixel circuit view showing a subpixel of a light emitting display device according to a first embodiment of the present disclosure.

FIG. 3 is a pixel circuit view showing a subpixel of a light emitting display device according to a first embodiment of the present disclosure.

In FIG. 3, the subpixel 200 includes first to sixth transistors 301, 302, 303, 304, 305 and 306 of a negative (N) type thin film transistor (TFT), first and second capacitors 307 and 308 and an emission element 309.

The first transistor 301 is a reference TFT, the second transistor 302 is a data TFT, the third transistor 303 is a driving TFT, the fourth transistor 304 is a merge TFT, and the fifth and sixth transistors 305 and 306 are a reset TFT.

The first capacitor 307 is a storage capacitor.

The emission element 309 corresponds to the emission element 220 of FIG. 2.

The subpixel 200 includes the reference voltage line Ref, the nth data signal line Dn, the mth scan signal line SSm, the nth merge signal line MSn, the mth reset signal line RSm, the high level voltage line Vdd, the low level voltage line Vss and the nth initial voltage line Inin.

The mth reset signal line RSm may be replaced by the (m-1)th scan signal line SSm-1.

During an initialization period, the fifth and sixth transistors 305 and 306 may be switched (turned on an off) according to a signal of the (m-1)th scan signal line SSm-1.

The nth merge signal line MSn supplies a signal having an opposite polarity to a signal of the mth scan signal SSm.

The high level voltage line Vdd supplying a high level voltage, the low level voltage line Vss supplying a low level voltage smaller than the high level voltage and the reference voltage line Ref supplying a reference voltage smaller than the high level voltage and greater than the low level voltage have a fixed potential.

The reference voltage line Ref may be replaced by the low level voltage line Vss.

The nth initial voltage line Inin may be replaced by the (n-1)th merge signal line MSn-1.

During the initialization period, a gate off voltage Voff may be supplied by the (n-1)th merge signal line MSn-1.

A voltage of the nth initial voltage line Inin is smaller than a voltage of the low level voltage line Vss.

The subpixel 200 includes first, second and third nodes N1, N2 and N3.

The first node N1 is connected to a first one of a source and a drain of the first transistor 301, a gate of the third transistor 303, one of a source and a drain of the fourth transistor 304 and one of a source and a drain of the fifth transistor 305.

The second node N2 is connected to a second one of a source and a drain of the second transistor 302, a second one of the source and the drain of the fourth transistor 304 and a first electrode of the first capacitor 307.

The third node N3 is connected to a first one of a source and a drain of the third transistor 303, a second one of the source and the drain of the fifth transistor 305, a first one of a source and a drain of the sixth transistor 306, a second electrode of the first capacitor 307, a first electrode of the second capacitor 308 and a first electrode of the emission element 309.

A gate of the first transistor 301 is connected to the mth scan signal line SSm, the first one of the source and the drain of the first transistor 301 is connected to the first node N1, and the second one of the source and the drain of the first transistor 301 is connected to the reference voltage line Ref.

During a programming period, the first transistor 301 supplies a reference voltage modification value Vref+Vthe to the first node N1 according to the signal of the mth scan signal line SSm.

The reference voltage modification value Vref+Vthe is obtained by the subpixel reference voltage modifying part 111.

A gate of the second transistor 302 is connected to the mth scan signal line SSm, a first one of the source and the drain of the second transistor 302 is connected to the nth data signal line Dn, and the second one of the source and the drain of the second transistor 302 is connected to the second node N2.

During the programming period, the second transistor 302 supplies a data voltage modification value Vdata+Vthd to the second node N2 according to a signal of the mth scan signal line SSm.

The data voltage modification value Vdata+Vthd is obtained by the image data voltage modifying part 113.

The gate of the third transistor 303 is connected to the first node N1, the first one of the source and the drain of the third transistor 303 is connected to the third node, and a second one of the source and the drain of the third transistor 303 is connected to the high level voltage line Vdd.

The third transistor 303 adjusts a current supplied from the high level voltage line Vdd to the emission element 309 through the third node N3 according to a voltage supplied to the first node N1 and drives the emission element 309.

A gate of the fourth transistor 304 is connected to the nth merge signal line MSn, the first one of the source and the drain of the fourth transistor 304 is connected to the first node N1, and the second one of the source and the drain of the fourth transistor 304 is connected to the second node N2.

During the initialization period and an emission period, the fourth transistor 304 connects the first and second nodes N1 and N2 according to a signal of the nth merge signal line MSn.

A gate of the fifth transistor 305 is connected to the mth reset signal line RSm, the first one of the source and the drain of the fifth transistor 305 is connected to the first node N1, and the second one of the source and the drain of the fifth transistor 305 is connected to the third node N3.

A gate of the sixth transistor 306 is connected to the mth reset signal line RSm, the first one of the source and the drain of the sixth transistor 306 is connected to the third node N3, and the second one of the source and the drain of the sixth transistor 306 is connected to the nth initial voltage line Inin.

During the initialization period, the fifth and sixth transistors 305 and 306 adjust each of the first, second and third nodes N1, N2 and N3 to have a voltage of the nth initial voltage line Inin according to a signal of the mth reset signal line RSm.

The first electrode of the first capacitor 307 is connected to the second node N2, and the second electrode of the first capacitor 307 is connected to the third node N3.

The first electrode of the second capacitor 308 and the anode of the emission element 309 are connected to the third node, and a second electrode of the second capacitor 308 and the cathode of the emission element 309 are connected to the low level voltage line Vss.

The second capacitor 308 represents that the emission element 309 functions as a capacitor when a reverse bias is applied.

Figure 4:
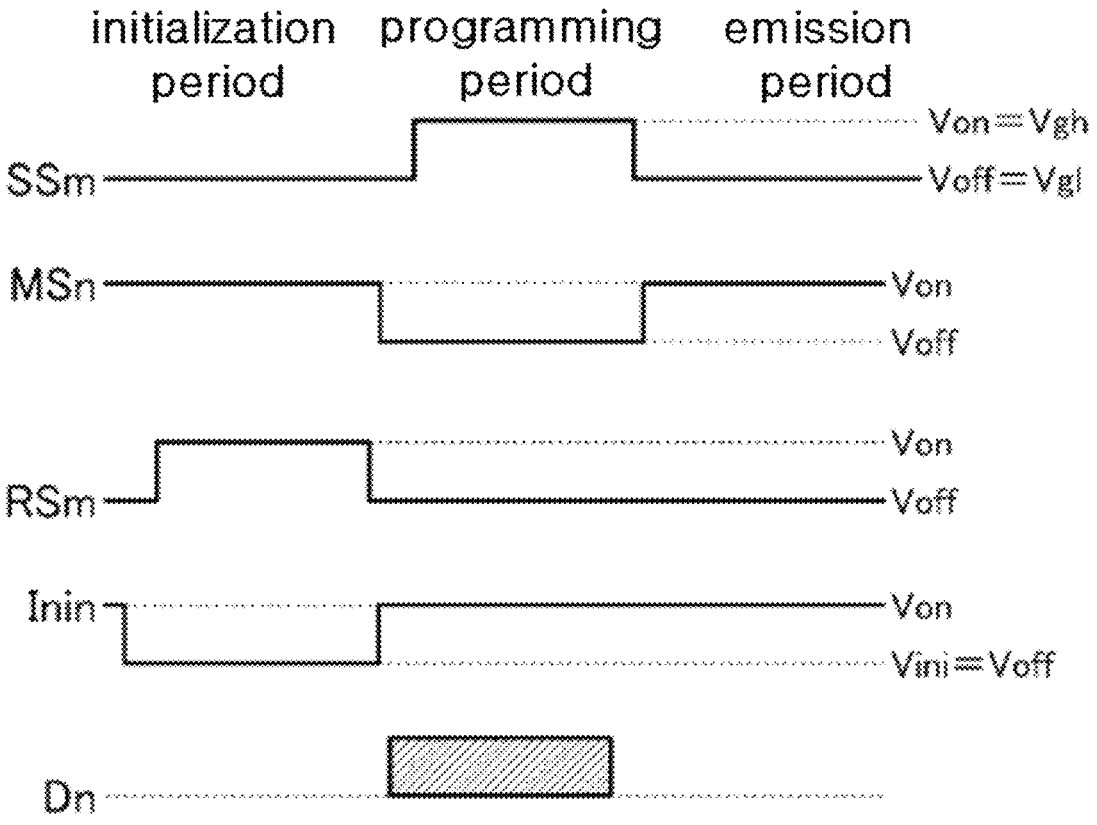
FIG. 4 is a timing chart showing signals of a pixel circuit of a light emitting display device according to a first embodiment of the present disclosure.

FIG. 4 is a timing chart showing signals of a pixel circuit of a light emitting display device according to a first embodiment of the present disclosure.

In FIG. 4, the pixel circuit is sequentially driven during the initialization period, the programming period and the emission period.

During the initialization period, each of the first, second and third nodes N1, N2 and N3 has the initial voltage Vini due to an active driving of the fourth, fifth and sixth transistors 304, 305 and 306.

During the programming period, the threshold voltage of the third transistor 303 is detected and a voltage corresponding to the data voltage compensation value Vdata+Vthd is stored to the first capacitor 307 due to an active driving of the first, second and third transistors 301, 302 and 303.

During the emission period, the emission element 309 emits a light by the third transistor 303 according to a voltage supplied from the first capacitor 307 due to an active driving of the third and fourth transistors 303 and 304.

Initialization Period

A gate on voltage Von of the reset signal is supplied to the mth reset signal line RSm, a gate on voltage Von of the merge signal of the nth merge signal line MSn, and a gate off voltage Voff of the scan signal of the mth scan signal line SSm.

As a result, the fourth, fifth and sixth transistors 304, 305 and 306 have an on state according to the gate on voltage Von.

The first and second transistors 301 and 302 have an off state according to the gate off voltage Voff, and the third transistor 303 has the off state according to a voltage of the nth initial voltage line Inin supplied to the first node N1.

As a result, the voltage of the nth initial voltage line Inin is supplied to the first, second and third nodes N1, N2 and N3 through the fourth, fifth and sixth transistors 304, 305 and 306 of the on state, and the first, second and third nodes N1, N2 and N3 are initialized to have the voltage of the nth initial voltage line Inin.

A voltage smaller than the voltage of the low level voltage line Vss is supplied as the voltage of the nth initial voltage line Inin.

For example, when the (n-1)th merge signal line MSn-1 is used as the initial voltage line Inin, the gate off voltage Voff of the (n-1)th merge signal line MSn-1 may be supplied as the voltage of the nth initial voltage line Inin.

As a result, the voltage of the nth initial voltage line Inin smaller than the voltage of the low level voltage line Vss is supplied to the third node N3, the emission element 309 does not emit a light due to the reverse bias, and charges are accumulated in the second capacitor 308 and the emission element 309.

During the initialization period, the (m-1)th scan signal line SSm-1 supplying the gate on voltage Von may be used as the mth reset signal line RSm.

An active period of the reset signal of the mth reset signal line RSm where the gate on voltage Von is supplied to the mth reset signal line RSm to prevent an emission of the emission element 309 is determined as a relatively short interval in the initialization period where the initial voltage of a low state.

The active period of the scan signal of the (m-1)th scan signal line SSm-1 where the gate on voltage Von is supplied to the (m-1)th scan signal line SSm-1 is determined in an inactive period of the merge signal of the (n-1)th merge signal line MSn-1 where the gate off voltage Voff is supplied to the (n-1)th merge signal line MSn-1 such that the active period of the scan signal of the (m-1)th scan signal line SSm-1 is shorter than the inactive period of the merge signal of the (n-1)th merge signal line MSn-1.

Programming Period

During the programming period, since the first, second and third transistors 301, 302 and 303 have an on state and the emission element 309 functions as the second capacitor 308, the threshold voltage of the third transistor 303 is detected.

At the same time, a voltage corresponding to the data voltage compensation value Vdata+Vth is stored in the first capacitor 307.

The gate on voltage Von of the scan signal is supplied to the mth scan signal line SSm, the gate off voltage Voff of the merge signal is supplied to the nth merge signal line MSn, and the gate off voltage Voff of the reset signal is supplied to the mth reset signal line RSm.

As a result, the first and second transistors have the on state according to the gate on voltage Von, the third transistor 303 has the on state according to the reference voltage modification value Vref+Vthe supplied to the first node N1 till a source drain current sufficiently decreases, and the fourth, fifth and sixth transistors 304, 305 and 306 have the off state according to the gate off voltage Voff.

When the data voltage modification value Vdata+Vthd is supplied through the second transistor 302 of the on state, the voltage of the second node N2 is changed from the gate off voltage Voff of the nth initial voltage line Inin to the data voltage modification value Vdata+Vthd, and the voltage of the third node N3 is also changed proportional to a voltage variation of the second node N2.

Here, since the voltage of the third node N3 is smaller than the low level voltage of the low level voltage line Vss, the emission element 309 functions as the second capacitor 308 due to application of the reverse bias.

The charges are accumulated in the emission element 309 as the second capacitor 308 through the third transistor 303 till the potential of the third node N3 becomes a voltage obtained by subtracting the threshold voltage of the third transistor 303 from the voltage of the reference voltage line Vref, i.e., till the source drain current Ids of the third transistor 303 sufficiently decreases.

As a result, a voltage obtained by subtracting the threshold voltage from the reference voltage, i.e., the threshold voltage of the third transistor 303 may be detected at the third node N3.

Specifically, since the threshold voltage is detected using the emission element 309 as the second capacitor 308, even the threshold voltage of a negative value may be exactly detected.

Accordingly, since the first capacitor 307 stores a difference of the data voltage Vdata supplied through the second transistor 302 of the on state and the voltage applied to the third node N3, the first capacitor 307 remembers a voltage corresponding to the data voltage compensation value.

The active period of the scan signal supplied to the mth scan signal line SSm is determined shorter than the inactive period of the merge signal of the nth merge signal line MSn.

The scan signal supplied to the (m-1)th scan signal line SSm-1 may be used as the reset signal of the mth reset signal line RSm during the programming period.

Emission Period

During the emission period, the fourth transistor 304 has the on state, and the emission element 309 emits a light according to a voltage of the first capacitor 307 by the third transistor 303.

The gate on voltage Von of the merge signal is supplied to the nth merge signal line MSn, the gate off voltage of the reset signal is supplied to the mth reset signal line RSm, and the gate off voltage of the scan signal is supplied to the mth scan signal line SSm.

As a result, the fourth transistor 304 has the on state according to the gate on voltage Von such that the first and second nodes N1 and N2 are connected to each other, and the first, second, fifth and sixth transistors 301, 302, 305 and 306 have the off state according to the gate off voltage Voff.

The third transistor 304 adjusts an output current Ids supplied from the high level voltage line Vdd to the emission element 309 according to a voltage of the first capacitor 307 supplied to the first node N1 through the fourth transistor 304 such that the emission element 309 emits a light.

The emission element 309 emits a light with a luminance proportional to a current density of the output current Ids of the third transistor 303.

Although the pixel circuit includes an N type TFT in the first embodiment, the present disclosure is not limited thereto and the pixel circuit may include a positive type TFT in another embodiment.

Figure 5:
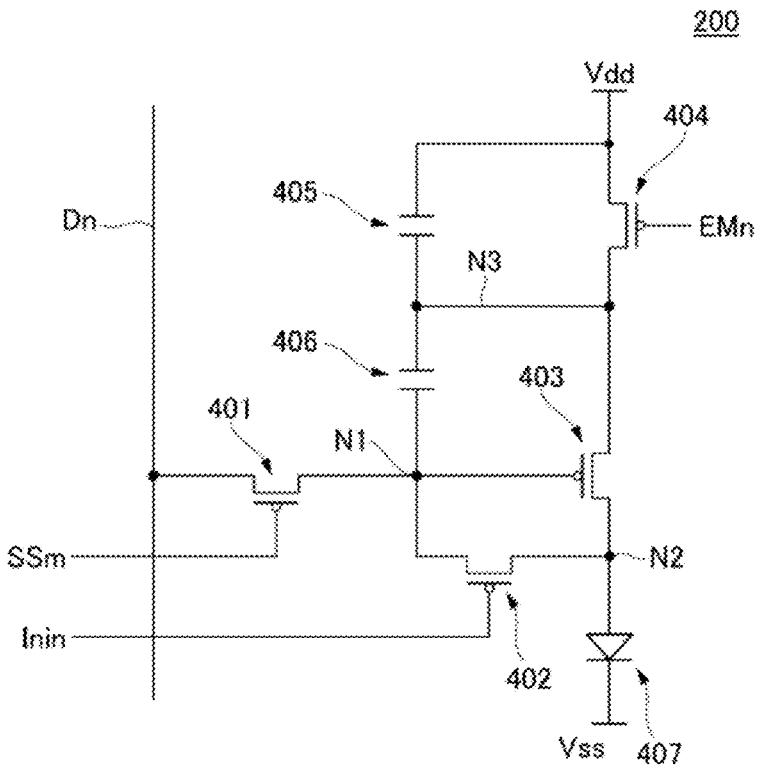
FIG. 5 is a pixel circuit view showing a subpixel of a light emitting display device according to a second embodiment of the present disclosure.

FIG. 5 is a pixel circuit view showing a subpixel of a light emitting display device according to a second embodiment of the present disclosure.

In FIG. 5, a subpixel 200 includes first to fourth transistors 401, 402, 403 and 404 of a positive (P) type TFT, first and second capacitors 405 and 406 and an emission element 407.

The third transistor 403 is a driving TFT.

The emission element 407 corresponding to the emission element 220 of FIG. 2.

The subpixel 200 includes an nth data signal line Dn, an mth scan signal line SSm, an nth emission signal line EMn instead of the nth merge signal line MSn of FIG. 3, a high level voltage line Vdd, a low level voltage line Vss and an initial voltage line Inin.

The subpixel 200 includes first, second and third nodes N1, N2 and N3.

The first node N1 is connected to a first one of a source and a drain of the first transistor 401, a first one of a source and a drain of the second transistor 402, a gate of the third transistor 403 and a first electrode of the second capacitor 406.

The second node N2 is connected to a second one of the source and the drain of the second transistor 402, a first one of a source and a drain of the third transistor 403 and an anode of the emission element 407.

The third node N3 is connected to a first electrode of the first capacitor 405, a second electrode of the second capacitor 406, a second one of the source and the drain of the third transistor 403 and a first one of a source and a drain of the fourth transistor 404.

A gate of the first transistor 401 is connected to the mth scan signal line SSm, the first one of the source and the drain of the first transistor 401 is connected to the first node, and the second one of the source and the drain of the first transistor 401 is connected to the nth data signal line Dn.

The first transistor 401 has an on state according to the scan signal of the mth scan signal line SSm to connect the nth data signal line Dn and the first node N1.

A gate of the second transistor 402 is connected to the nth initial voltage line Inin, the first one of the source and the drain of the second transistor 402 is connected to the first node N1, and the second one of the source and the drain of the second transistor 402 is connected to the second node N2.

The second transistor 402 has an on state according to the initial signal of the nth initial signal line Inin to connect the first and second nodes N1 and N2.

A gate of the third transistor 403 is connected to the first node N1, the first one of the source and the drain of the third transistor 403 is connected to the second node N2, and the second one of the source and the drain of the third transistor 403 is connected to the high level voltage line Vdd.

The first electrode of the first capacitor 405 is connected to the third node N3, and the second electrode of the first capacitor 405 is connected to the high level voltage line Vdd.

The first capacitor 405 may stabilize a voltage of the third node N3.

The first electrode of the second capacitor 406 is connected to the first node N1, and the second electrode of the second capacitor 406 is connected to the third node N3.

The anode of the emission element 407 is connected to the second node N2, and the cathode of the emission element 407 is connected to the low level voltage line Vss.

Figure 6:
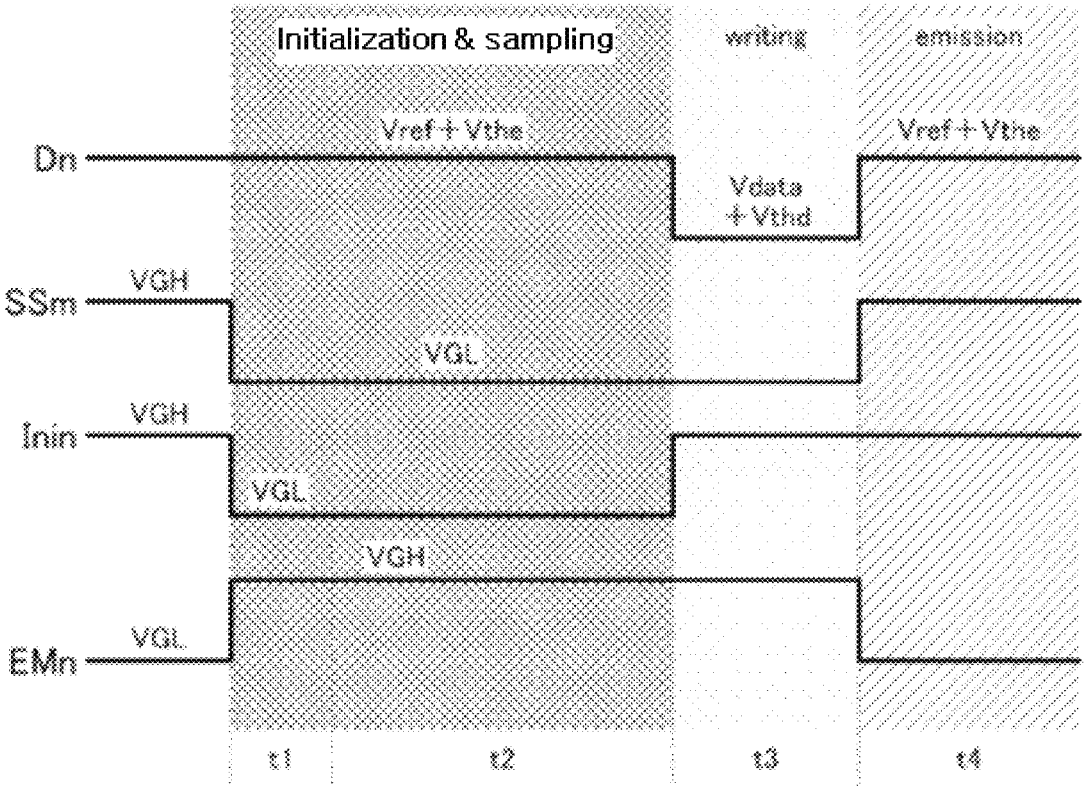
FIG. 6 is a timing chart showing signals of a pixel circuit of a light emitting display device according to a second embodiment of the present disclosure.

FIG. 6 is a timing chart showing signals of a pixel circuit of a light emitting display device according to a second embodiment of the present disclosure.

In FIG. 6, the pixel circuit is sequentially driven during an initialization and sampling period, a writing period and an emission period.

Initialization and Sampling Period

During the initialization and sampling period, a reference voltage modification value Vref+Vthe of a high level voltage is supplied to the nth data signal line Dn, a gate low voltage VGL of a low level voltage is supplied to the mth scan signal line SSm, the gate low voltage VGL of a low level voltage is supplied to the nth initial voltage line Inin, and a gate high voltage VGH of a high level voltage is supplied to the nth emission signal line ENn.

As a result, the first and second transistors 401 and 402 have an on state, and the fourth transistor 404 has an off state.

Since the reference voltage modification value Vref+Vthe is supplied to the first and second nodes N1 and N2 through the first and second transistors 401 and 402 of an on state, the first and second nodes N1 and N2 are initialized to have the reference voltage modification value Vref+Vthe.

When a voltage of the third node N3 becomes the reference voltage modification value Vref+Vthe, the third transistor 403 has an off state and discharge of the third node N3 is stopped.

The voltage of the third node N3 is stored in the first and second capacitors 405 and 406.

Writing Period

During the writing period, the data voltage modification value Vdata+Vthd of a low level voltage is supplied to the nth data signal line Dn, the gate low voltage VGL of a low level voltage is supplied to the mth scan signal line SSm, the gate high voltage VGH of a high level voltage is supplied to the nth initial voltage line Inin, and the gate high voltage VGH of a high level voltage is supplied to the nth emission signal line EMn.

As a result, the first transistor 401 has an on state, and the second, third and fourth transistors 402, 403 and 404 have an off state.

Since the data voltage modification value Vdata+Vthd is supplied to the first node N1 through the first transistor 401 of an on state, a voltage of the first node N1 becomes the data voltage modification value Vdata+Vthd.

Emission Period

During the emission period, the reference voltage modification value Vref+Vthe of a high level voltage is supplied to the nth data signal line Dn, the gate high voltage VGH of a high level voltage is supplied to the mth scan signal line SSm, the gate high voltage VGH of a high level voltage is supplied to the nth initial voltage line Inin, and the gate low voltage VGL of a low level voltage is supplied to the nth emission signal line EMn.

As a result, the first and second transistors 401 and 402 have an off state, and the fourth transistor 404 has an on state such that the emission element 407 emits a light.

Since the gate of the third transistor 403 connected to the first node N1 has the data voltage modification value Vdata+Vthd of a low level voltage, the third transistor 403 has an on state, and a voltage of the high level voltage line Vdd is supplied to the third node N3.

A simulation result of the pixel circuits of a first embodiment and a comparison example will be illustrated hereinafter. The pixel circuit of a first embodiment uses the reference voltage modification value as a reference voltage and the data voltage modification value as a data voltage, and the pixel circuit of a comparison example uses the original reference and the original data voltage.

In the simulation, the driving transistor has the threshold voltage Vth.

Figure 7A:
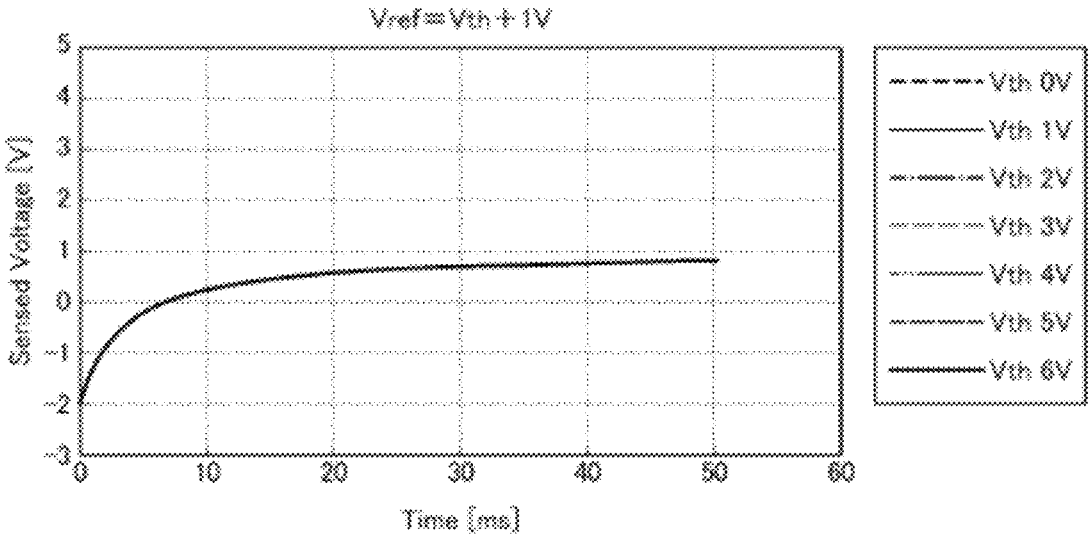
FIG. 7A is a view showing a sensed voltage with respect to a time with a reference voltage of a sum of a threshold voltage and 1V (Vref=Vth+1V) according to a first embodiment of the present disclosure.

FIG. 7A is a view showing a sensed voltage with respect to a time with a reference voltage of a sum of a threshold voltage and 1V (Vref=Vth+1V) according to a first embodiment of the present disclosure. In FIG. 7A, since the sensed voltages are the same as each other regardless of the threshold voltage Vth, lines for the sensed voltages overlap each other.

Figure 7B:
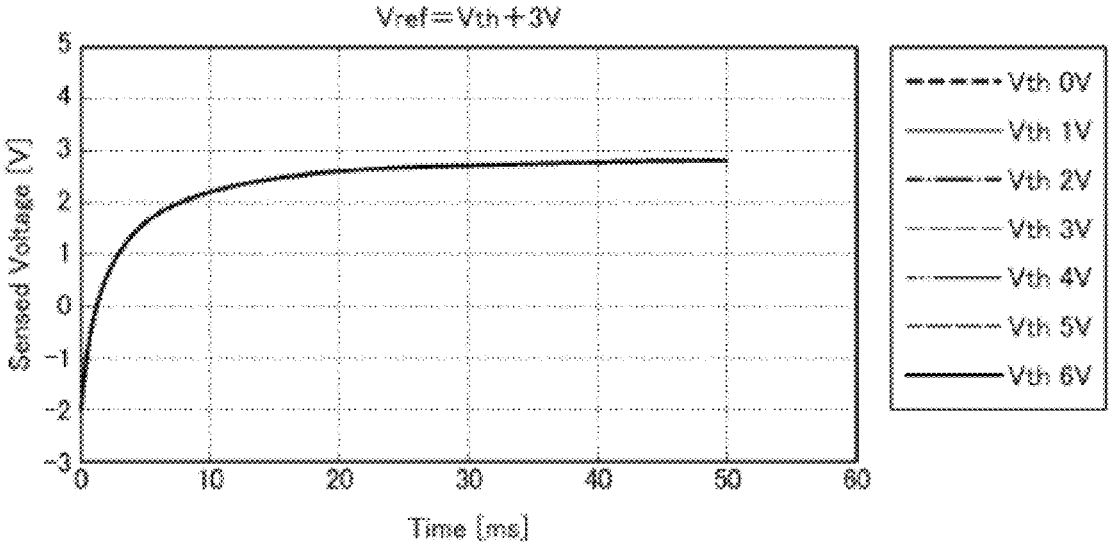
FIG. 7B is a view showing a sensed voltage with respect to a time with a reference voltage of a sum of a threshold voltage and 3V (Vref=Vth+3V) according to a first embodiment of the present disclosure.

FIG. 7B is a view showing a sensed voltage with respect to a time with a reference voltage of a sum of a threshold voltage and 3V (Vref=Vth+3V) according to a first embodiment of the present disclosure. In FIG. 7B, since the sensed voltages are the same as each other regardless of the threshold voltage Vth, lines for the sensed voltages overlap each other.

Figure 8A:
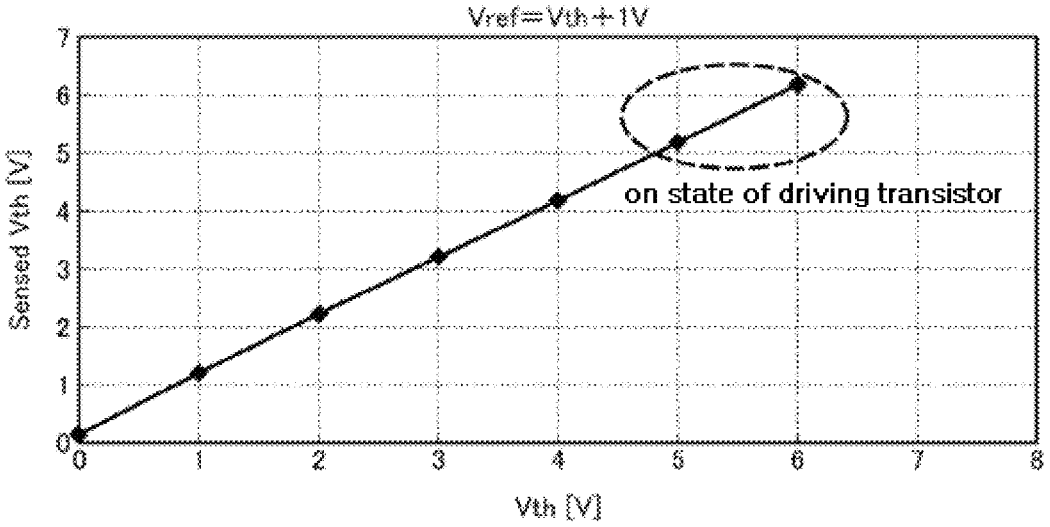
FIG. 8A is a view showing a sensed voltage with respect to a threshold voltage with a reference voltage of a sum of a threshold voltage and 1V (Vref=Vth+1V) according to a first embodiment of the present disclosure.

FIG. 8A is a view showing a sensed voltage with respect to a threshold voltage with a reference voltage of a sum of a threshold voltage and 1V (Vref=Vth+1V) according to a first embodiment of the present disclosure.

Figure 8B:
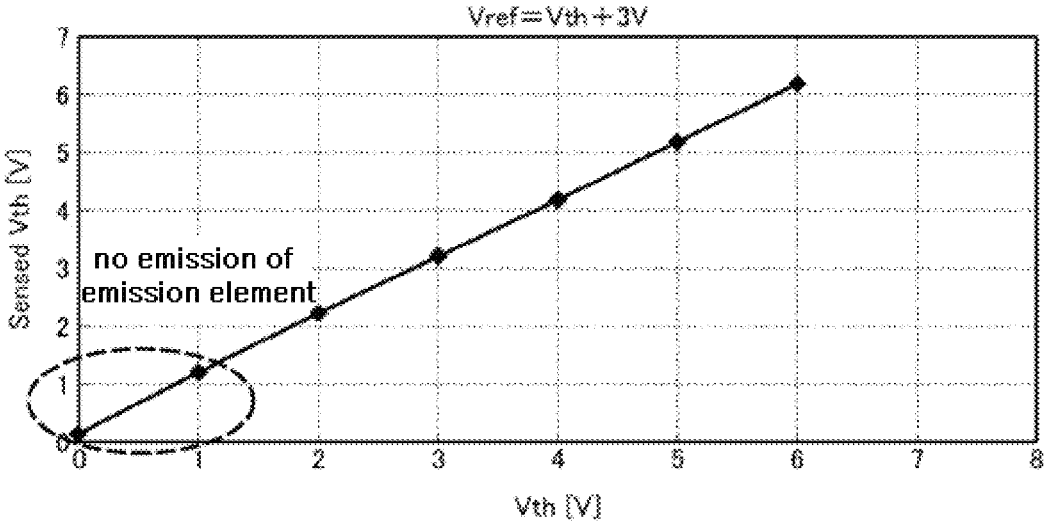
FIG. 8B is a view showing a sensed voltage with respect to a threshold voltage with a reference voltage of a sum of a threshold voltage and 3V (Vref=Vth+3V) according to a first embodiment of the present disclosure.

FIG. 8B is a view showing a sensed voltage with respect to a threshold voltage with a reference voltage of a sum of a threshold voltage and 3V (Vref=Vth+3V) according to a first embodiment of the present disclosure.

Figure 9A:
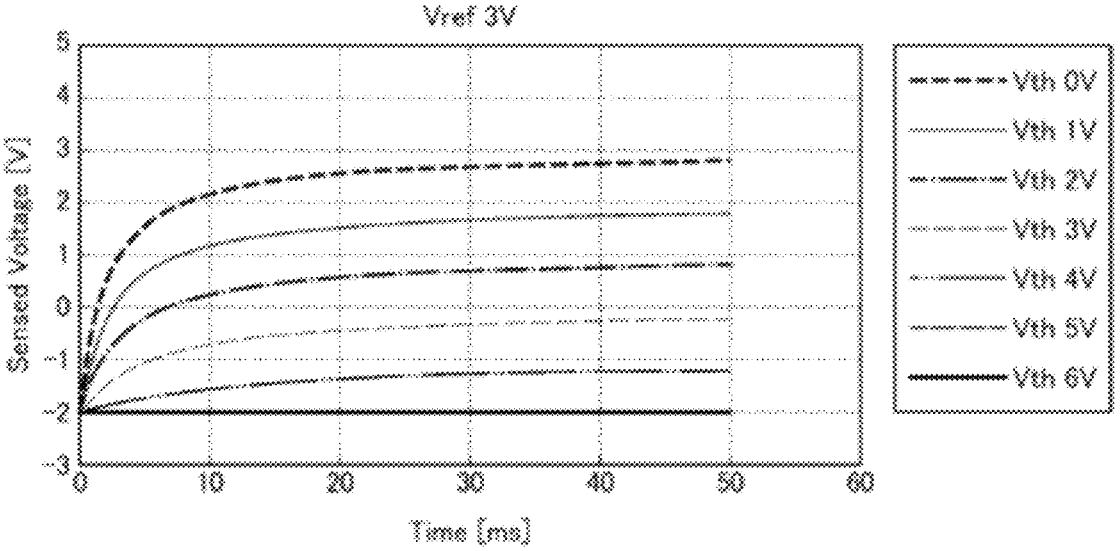
FIG. 9A is a view showing a sensed voltage with respect to a time with a reference voltage of 3V (Vref=3V) according to a comparison example.

FIG. 9A is a view showing a sensed voltage with respect to a time with a reference voltage of 3V (Vref=3V) according to a comparison example.

Figure 9B:
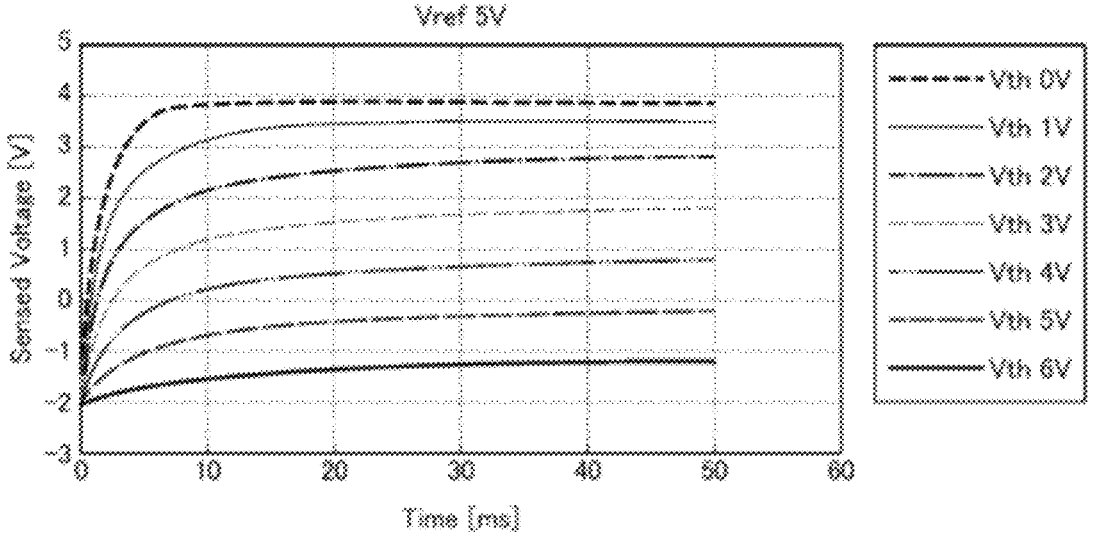
FIG. 9B is a view showing a sensed voltage with respect to a time with a reference voltage of 5V (Vref=5V) according to a comparison example.

FIG. 9B is a view showing a sensed voltage with respect to a time with a reference voltage of 5V (Vref=5V) according to a comparison example.

Figure 10A:
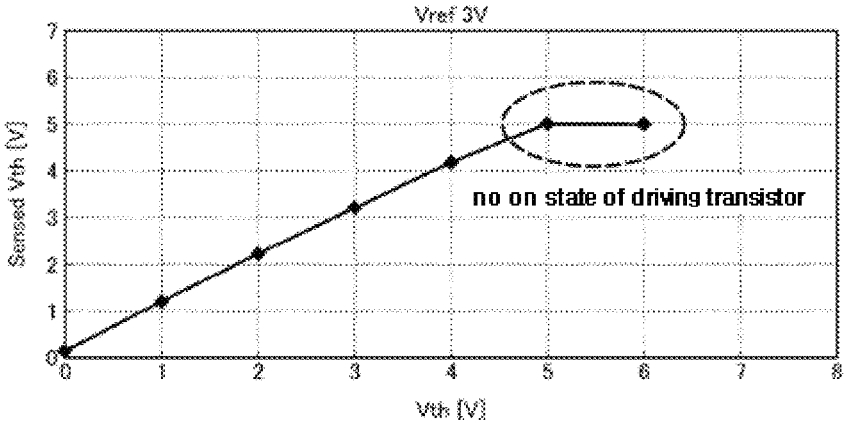
FIG. 10A is a view showing a sensed voltage with respect to a threshold voltage with a reference voltage of 3V (Vref=3V) according to a comparison example.

FIG. 10A is a view showing a sensed voltage with respect to a threshold voltage with a reference voltage of 3V (Vref=3V) according to a comparison example.

Figure 10B:
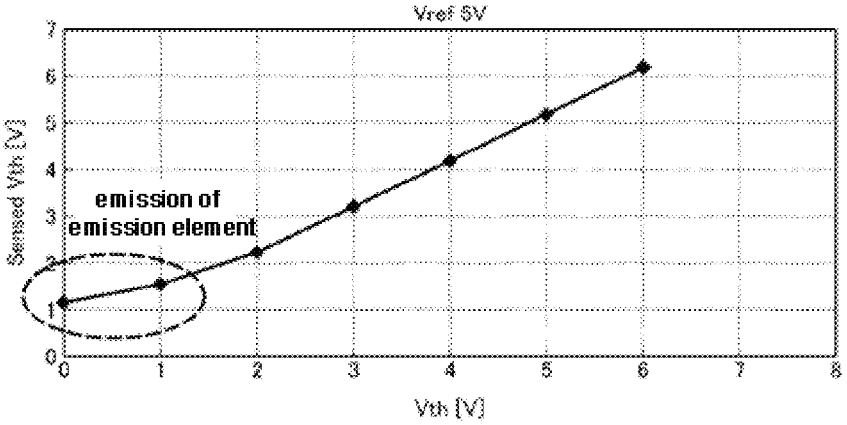
FIG. 10B is a view showing a sensed voltage with respect to a threshold voltage with a reference voltage of 5V (Vref=5V) according to a comparison example.

FIG. 10B is a view showing a sensed voltage with respect to a threshold voltage with a reference voltage of 5V (Vref=5V) according to a comparison example.

In FIGS. 8A and 10A, while the driving transistor does not have an on state when Vth>5V in the comparison example, the driving transistor has an on state when Vth>5V in the first embodiment.

In FIGS. 8B and 10B, while the emission element emits a light when Vth<1V in the comparison example, the emission element does not emit a light when Vth<1V in the first embodiment.

As a result, a voltage compensation is properly performed, and the light emitting display device having a stable high quality display is obtained.

Since the reference voltage modification value of a sum of the reference voltage and the threshold voltage estimation value of the driving transistor is used as an updated reference voltage, the threshold voltage in an initial state of detection is detected. Since the data voltage modification value of a sum of the data voltage and the threshold voltage estimation value of the driving transistor is used as an updated data voltage, the threshold voltage detection value is compensated.

Accordingly, a proper voltage compensation is obtained, and a light emitting display device having a stable high quality is obtained.

Although the threshold voltage estimation is performed through a data counting method based on deterioration of each subpixel in the first embodiment, the present disclosure is not limited thereto and the threshold voltage estimation may be performed based on deterioration of a whole panel in another embodiment.

Figure 11:
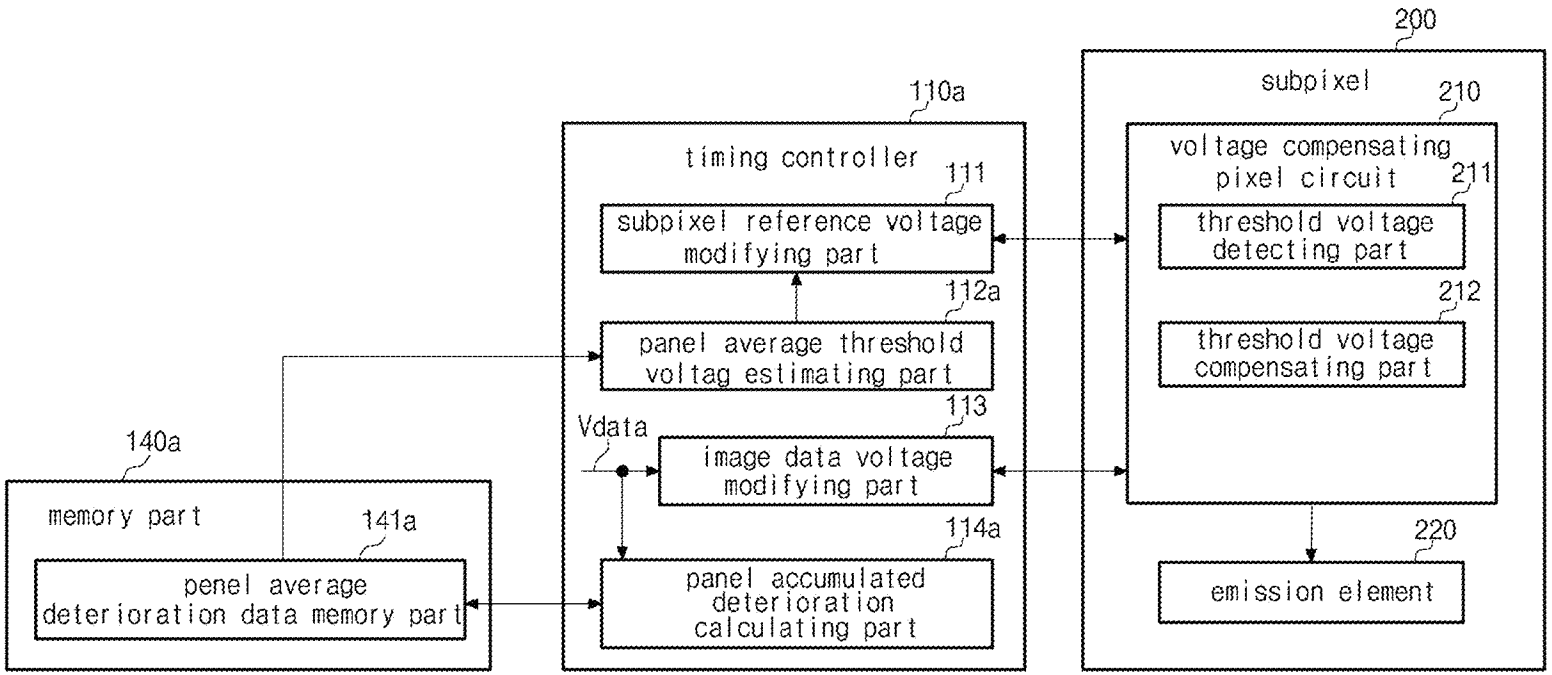
FIG. 11 is a view showing a timing controller, a memory part and a subpixel of a light emitting display device according to a third embodiment of the present disclosure.

FIG. 11 is a view showing a timing controller, a memory part and a subpixel of a light emitting display device according to a third embodiment of the present disclosure.

In FIG. 11, a timing controller 110*a* includes a panel average threshold voltage estimating part 112*a* instead of the subpixel threshold voltage estimating part 112 of FIG. 2 and a panel accumulated deterioration calculating part 114*a* instead of the subpixel accumulated deterioration calculating part 114 of FIG. 2.

A memory part 140*a* includes a panel average deterioration data memory part 141*a* instead of the subpixel deterioration data memory part 141 of FIG. 2.

The panel average threshold voltage estimating part 112*a* generates a threshold voltage estimation value Vthe by estimating a threshold voltage average value of the driving transistor in a whole panel.

The panel accumulated deterioration calculating part 114*a* calculates an average accumulated deterioration of the whole panel by adding a function f(Vdata) of the data voltage Vdata to the deterioration data in the whole panel.

The panel average deterioration data memory part 141*a* remembers the deterioration data in the whole panel.

Accordingly, a proper voltage compensation is obtained and a light emitting display device having a stable high quality is obtained by detecting deterioration of the whole panel instead of detecting deterioration of each subpixel.

Although the threshold voltage estimation is performed based on deterioration of a whole panel and the threshold voltage detection and the data writing are simultaneously performed in the third embodiment, the present disclosure is not limited thereto and the threshold voltage detection and the data writing may be performed with different timings in another embodiment.

Figure 12:
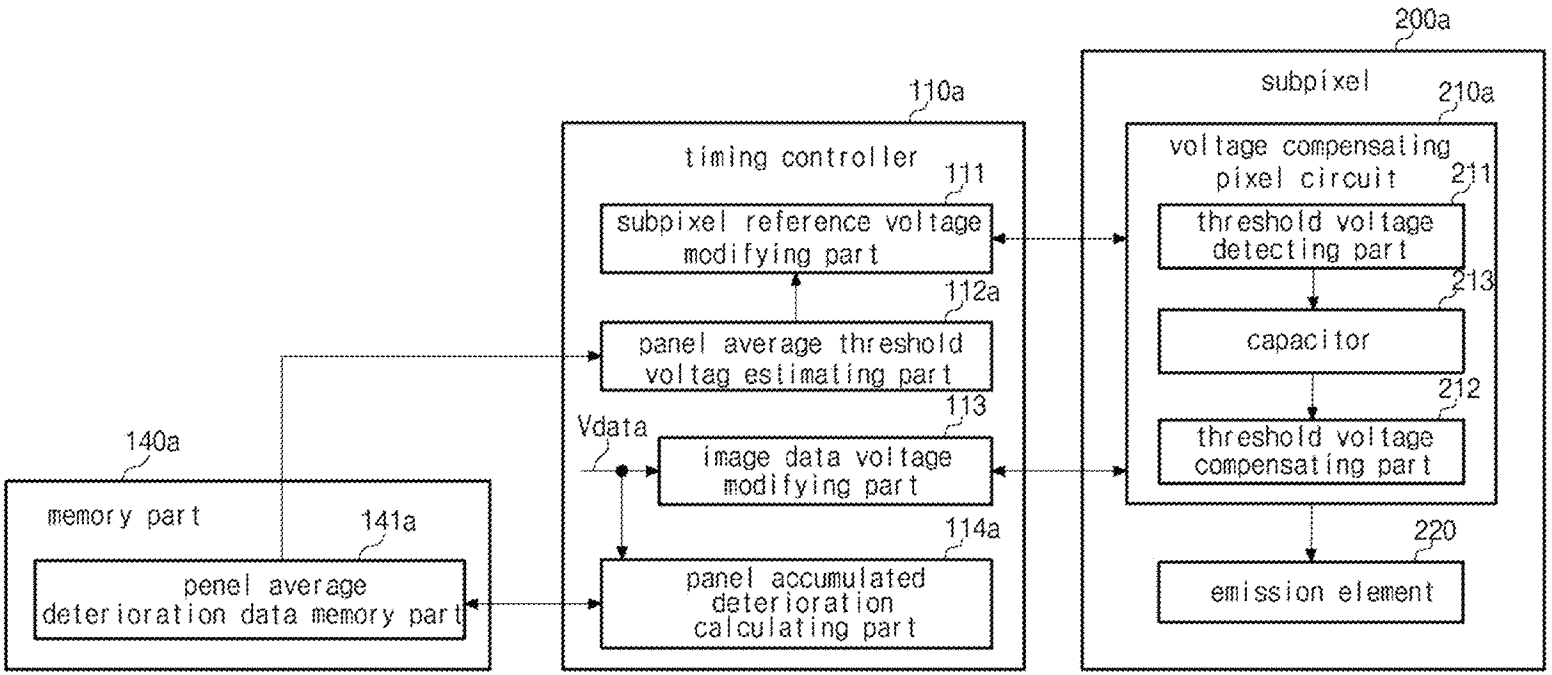
FIG. 12 is a view showing a timing controller, a memory part and a subpixel of a light emitting display device according to a fourth embodiment of the present disclosure.

FIG. 12 is a view showing a timing controller, a memory part and a subpixel of a light emitting display device according to a fourth embodiment of the present disclosure.

In FIG. 12, a subpixel 200*a* includes a voltage compensating pixel circuit 210*a* instead of the voltage compensating pixel circuit 210 of FIG. 11.

The voltage compensating pixel circuit 210*a* includes a capacitor 213 between a threshold voltage detecting part 211 and a threshold voltage compensating part 212.

The capacitor 213 stores the threshold voltage detection value detected by the threshold voltage detecting part 211, and the threshold voltage compensating part 212 reads the threshold voltage detection value of the capacitor 213.

Although the capacitor 213 is used for storage of the threshold voltage detection value in the fourth embodiment, the present disclosure is not limited thereto and a different memory element instead of the capacitor 213 may be used in another embodiment.

Accordingly, a proper voltage compensation is obtained and a light emitting display device having a stable high quality is obtained by performing the threshold voltage detection and the data writing with different timings.

Consequently, in the light emitting display device, the threshold voltage is detected in the detection initial state of the driving transistor, and the data voltage is compensated by the threshold voltage detection value.

It will be apparent to those skilled in the art that various modifications and variations can be made in the light emitting display device of present disclosure without departing from the technical idea or scope of the disclosure. Thus, it is intended that the present disclosure cover the modifications and variations of this disclosure provided they come within the scope of the appended claims and their equivalents.

What is claimed is:

1. A light emitting display device in which a pixel circuit for detecting a threshold voltage of a driving transistor in each of a plurality of subpixels is arranged in a matrix, comprising:

a threshold voltage estimating part configured to generate a threshold voltage estimation value by estimating the threshold voltage of the driving transistor through a data counting method;

a reference voltage modifying part configured to generate a reference voltage modification value by modifying a reference voltage used for detecting the threshold voltage based on the threshold voltage estimation value;

an image data voltage modifying part configured to generate an image data voltage modification value by adding a threshold voltage detection value to a data voltage corresponding to an image data; and an accumulated deterioration calculating part configured to calculate an accumulated deterioration by accumulating a deterioration data of a function of the data voltage, wherein:

the reference voltage modification value is a sum of the reference voltage and the threshold voltage estimation value;

to detect the threshold voltage of the driving transistor:

the light emitting display device is configured to supply the reference voltage modification value to a gate of the driving transistor and to supply the image data voltage modification value to a node coupled to a source of the driving transistor, wherein the node is not at the gate of the driving transistor;

each of the plurality of subpixels comprises a first transistor, a second transistor, a third transistor and a capacitor;

the first transistor is coupled to the gate of the driving transistor and is configured to supply the reference voltage modification value to the gate of the driving transistor;

the second transistor is coupled to the source of the driving transistor and is configured to supply the image data voltage modification value to the node;

a gate of the first transistor and a gate of the second transistor are coupled to a first signal line;

a first end of the capacitor is directly connected to the second transistor, and a second end of the capacitor is directly connected to the source of the driving transistor, wherein the second end is different from the first end; and one end of the third transistor is directly connected to the gate of the driving transistor, and another end of the third transistor is directly connected to the second transistor, wherein the another end is different from the one end.

2. The device of claim 1, wherein the threshold voltage is detected as the threshold voltage detection value using the reference voltage.

3. The device of claim 1, wherein:

the threshold voltage estimating part is further configured to estimate the threshold voltage of the driving transistor in each of the plurality of subpixels; and the accumulated deterioration calculating part is further configured to calculate the accumulated deterioration by accumulating the deterioration data of the driving transistor of each of the plurality of subpixels.

4. The device of claim 3, wherein detection and compensation of the threshold voltage of the driving transistor are simultaneously performed.

5. The device of claim 1, wherein:

the threshold voltage estimating part is further configured to estimate a threshold voltage average value of the driving transistor of a whole of the plurality of subpixels; and the accumulated deterioration calculating part is further configured to calculate the accumulated deterioration of the driving transistor of a whole of the plurality of subpixels.

6. The device of claim 5, wherein detection and compensation of the threshold voltage of the driving transistor are simultaneously performed.

7. The device of claim 5, wherein detection and compensation of the threshold voltage of the driving transistor are performed with different timings.

8. The device of claim 1, wherein:

the node is at a drain of the second transistor;

each of the plurality of subpixels further comprises:

an emission element coupled to the source of the driving transistor; and when the image data voltage modification value is supplied to the node, the emission element is configured to function as a capacitor.

9. The device of claim 1, wherein the threshold voltage estimating part is configured to generate the threshold voltage estimation value by estimating the threshold voltage of the driving transistor through the data counting method, based on an average deterioration data of the plurality of subpixels stored in a memory.

10. The device of claim 1, wherein:

the gate, a source and a drain of the first transistor are directly connected to the first signal line, a first node and a reference line, respectively, wherein the first node is directly connected to the gate of the driving transistor;

the gate, a source and a drain of the second transistor are directly connected to the first signal line, a second signal line, and the node, respectively, wherein the node is directly connected to the first end of the capacitor;

a gate, a source and a drain of the third transistor are directly connected to a merge signal line, the node and the first node, respectively; and the capacitor is disposed directly between the drain of the second transistor and the source of the driving transistor.

11. The device of claim 10, wherein:

each of the plurality of subpixels further comprises a fourth transistor; and a gate, a source and a drain of the fourth transistor are directly connected to a reset signal line, the source of the driving transistor, and the gate of the driving transistor, respectively.

12. The device of claim 11, wherein:

each of the plurality of subpixels further comprises a fifth transistor; and a gate, a source and a drain of the fifth transistor are directly connected to the reset signal line, the source of the driving transistor, and an initial voltage line, respectively.

13. A light emitting display device, comprising:

a plurality of subpixels arranged in a matrix, each of the plurality of subpixels including a voltage compensating pixel circuit comprising a driving transistor and an emission element emitting a light due to a control of the voltage compensation pixel circuit;

a timing controller configured to output a control signal to a data driving circuit and a gate driving circuit connected to the plurality of subpixels based on a timing synchronization signal and a data current, wherein the timing controller is further configured to:

detect a threshold voltage of the driving transistor as a threshold voltage detection value by modifying a reference voltage using a threshold voltage estimation value of a shift amount of the threshold voltage through a data counting method; and modify an image data voltage using the threshold voltage detection value, wherein the modified reference voltage is a sum of the reference voltage and the threshold voltage estimation value, wherein to detect the threshold voltage of the driving transistor:

the light emitting display device is configured to supply the modified reference voltage to a gate of the driving transistor and to supply the modified image data voltage to a node coupled to a source of the driving transistor, wherein the node is not at the gate of the driving transistor, wherein each of the plurality of subpixels comprises a first transistor, a second transistor, a third transistor and a capacitor, wherein the first transistor is coupled to the gate of the driving transistor and is configured to supply the modified reference voltage to the gate of the driving transistor, wherein the second transistor is coupled to the source of the driving transistor and is configured to supply the modified image data voltage to the node, wherein a gate of the first transistor and a gate of the second transistor are coupled to a first signal line, wherein a first end of the capacitor is directly connected to the second transistor, and a second end of the capacitor is directly connected to the source of the driving transistor, wherein the second end is different from the first end, and wherein one end of the third transistor is directly connected to the gate of the driving transistor, and another end of the third transistor is directly connected to the second transistor, wherein the another end is different from the one end.

14. The device of claim 13, wherein the timing controller is further configured to:

calculate an accumulated deterioration by accumulating a deterioration data of the driving transistor of each of the plurality of subpixels; and estimate the threshold voltage of the driving transistor of each of the plurality of subpixels.

15. The device of claim 14, wherein detection and compensation of the threshold voltage of the driving transistor are simultaneously performed.

16. The device of claim 13, wherein the timing controller is further configured to:

calculate an accumulated deterioration by accumulating a deterioration data of the driving transistor of each of the plurality of subpixels; and estimate a threshold voltage average value of the driving transistor of the plurality of sub pixels.

17. The device of claim 16, wherein detection and compensation of the threshold voltage of the driving transistor are simultaneously performed.

18. The device of claim 16, wherein detection and compensation of the threshold voltage of the driving transistor are performed with different timings.

19. The device of claim 13, further comprising:

a memory configured to store an average deterioration data of the plurality of subpixels, wherein the timing controller is configured to detect the threshold voltage of the driving transistor as the threshold voltage detection value by modifying the reference voltage using the threshold voltage estimation value of the shift amount of the threshold voltage through the data counting method, based on the average deterioration data of the plurality of subpixels.

20. A light emitting display device in which a pixel circuit detecting a threshold voltage of a driving transistor in each of a plurality of subpixels is arranged in a matrix, comprising:

a threshold voltage estimating part configured to generate a threshold voltage estimation value by estimating the threshold voltage of the driving transistor through a data counting method;

a reference voltage modifying part configured to generate a reference voltage modification value by modifying a reference voltage used for detecting the threshold voltage based on the threshold voltage estimation value;

an image data voltage modifying part configured to generate an image data voltage modification value by adding a threshold voltage detection value to a data voltage corresponding to an image data; and an accumulated deterioration calculating part configured to calculate an accumulated deterioration by accumulating a deterioration data of a function of the data voltage, wherein:

the reference voltage modification value is a sum of the reference voltage and the threshold voltage estimation value;

to detect the threshold voltage of the driving transistor:

the light emitting display device is configured to supply the reference voltage modification value to a first node connected to a gate of the driving transistor and to supply the image data voltage modification value to a second node coupled to a source of the driving transistor;

each of the plurality of subpixels comprises first, second and third transistors and a capacitor;

a gate, a source and a drain of the first transistor are coupled to a scan signal line, the first node and a reference line, respectively, wherein the drain of the first transistor is directly connected to the reference line;

a gate, a source and a drain of the second transistor are directly coupled to the scan signal line, a data signal line and the second node, respectively; and a gate, a source and a drain of the third transistor are coupled to a merge signal line, the second node and the first node, respectively, wherein a first end of the capacitor is directly connected to the second node, wherein a second end of the capacitor is directly connected to the source of the driving transistor, wherein the second end is different from the first end, wherein the drain of the third transistor is directly connected to the first node, wherein the first node is directly connected to the gate of the driving transistor, and wherein the source of the third transistor is directly connected to the second node.

* * * * *